US005647752A

United States Patent [19]

Taguchi

[11] Patent Number: 5,647,752

[45] Date of Patent: Jul. 15, 1997

[54] LEVER-TYPE CONNECTOR

[75] Inventor: Naoto Taguchi, Shizuoka, Japan

[73] Assignee: Yazaki Corporation, Tokyo, Japan

[21] Appl. No.: 438,961

[22] Filed: May 11, 1995

[30] Foreign Application Priority Data

May 12, 1994 [JP] Japan ..... 6-098763

[51] Int. Cl.[6] ..... H01R 13/62

[52] U.S. Cl. ..... 439/157; 439/153

[58] Field of Search ..... 439/157, 153

[56] References Cited

U.S. PATENT DOCUMENTS

| | | | |
|---|---|---|---|
| 5,135,408 | 8/1992 | Suzuki | 439/157 X |
| 5,171,156 | 12/1992 | Nagasaka et al. | 439/157 |
| 5,174,785 | 12/1992 | Endo et al. . | |
| 5,183,408 | 2/1993 | Hatagishi | 439/157 X |
| 5,257,942 | 11/1993 | Taguchi | 439/157 |
| 5,463,912 | 11/1995 | Inoue et al. | 439/157 X |

FOREIGN PATENT DOCUMENTS 2-56875 2/1990 Japan .

*Primary Examiner*—Jes F. Pascua

*Attorney, Agent, or Firm*—Morgan, Lewis and Bockius, LLP

[57] ABSTRACT

A retaining lever is pivotally mounted on a female connector housing, and sliding grooves are formed respectively in opposite sides of the retaining lever. Guide projections, formed respectively on opposite sides of a male connector, are received in the sliding grooves, respectively, and then the retaining lever is pivotally moved to fit the two connectors together in a retained manner. Flanged projections are formed respectively on those portions of the opposite sides of the retaining lever through which a pivot axis passes. The flanged projection has a pillar-like support shaft portion, a flange formed at a distal end of the support shaft portion, and a protuberance. Receiving grooves for respectively receiving the support shaft portions are formed in the opposite sides of the housing, respectively, and engagement portions for respectively retaining the protuberances when the flanged projections are received respectively in the receiving grooves are provided respectively at the opposite sides of the housing along the respective receiving grooves.

12 Claims, 6 Drawing Sheets

LEVER-TYPE CONNECTOR

BACKGROUND OF THE INVENTION

1. Field of Invention

This invention relates to a lever-type connector used for connecting wire harnesses in transportation applications such as in an automobile.

2. Related Art

A conventional connector of the type described is shown in FIGS. 14 and 15.

In FIG. 14, a female connector housing 52 has at its front side a receiving opening for receiving a mating connector, and a plurality of male terminals (not shown) are provided within this connector housing 52 at a generally central portion thereof. Wires, connected respectively to the male terminals, extend out of a rear end of the connector housing 52. A pair of projections 53 are respectively formed on opposite sides of the connector housing 52 at a generally central portion thereof, and project perpendicularly to the axis (longitudinal direction) of the connector housing.

A lever 50 for mounting on the connector housing 52 has a generally downwardly-open U-shape, and has fitting holes 51 formed respectively through opposite side walls thereof, the fitting holes 51 being fitted respectively on the projections 53, so that the lever 50 is pivotally movable about the projections 53.

In this lever-type connector, by pivotally moving the lever 50, the mating connector is drawn into and withdrawn from the connector housing 52 through the receiving opening with a low insertion force, thereby achieving the connection and disconnection of the two connectors relative to each other.

FIG. 15 is a perspective view showing the lever 50 pivotally mounted on the connector housing.

As is clear from FIG. 15, the width of the lever 50 and the distance between the two fitting holes 51 and 51 are smaller than the distance between the distal ends of the two projections 53 and 53 formed respectively on the opposite sides of the connector housing 52. Therefore, when the lever 50 is to be attached to the connector housing 52, the operator must first force the opposite side walls of the lever 50 away from each other as indicated by arrows E, and in this condition the fitting holes 51 are fitted respectively on the projections 53 on the connector housing 52.

In the conventional lever-type connector, there has been required such a cumbersome operation in which the lever 50 is connected to the projections 53 while kept in an expanded condition, as described above. Because of this, it has been difficult to enhance the efficiency of the assembling operation. And besides, where the lever material is insufficiently elastic, expansion may impart a plastic deformation to the lever. Thus, this construction has not been suited for providing a good quality product.

Another disadvantage is that if an expanding force again acts on the lever for some reason even after the lever is mounted on the connector housing, the lever can be easily disengaged from the projections.

SUMMARY OF THE INVENTION

The present invention has been made in view of the above problems, and an object of the invention is to provide a lever-type connector provided with a retaining lever, in which the retaining lever can be easily mounted on a connector housing in a connector-assembling process, and the retaining lever once mounted on the connector housing is prevented from disengagement therefrom.

The above object has been achieved by a lever-type connector of the present invention wherein a retaining lever is mounted on one of a pair of male and female connectors to be fitted together so that the retaining lever can be pivotally moved about a pivot axis passing through opposite sides of a housing of the one connector, and the retaining lever is pivotally moved to fit the two connectors together in a retained manner; CHARACTERIZED in that projections are formed respectively on opposite sides of one of the retaining lever and the one connector housing on which the retaining lever is mounted, while receiving grooves for respectively receiving the projections, as well as engagement portions for respectively retaining the received projections, are formed respectively in the opposite sides of the other.

In the lever-type connector of the invention, sliding grooves for respectively receiving guide projecting portions formed on and projecting from the other connecter are formed respectively on the opposite sides of the retaining lever, and the projection includes a pillar-like support shaft portion, and a flange formed on a distal end of the support shaft portion, and the support shaft portion is received in the associated receiving groove.

In the lever-type connector of the present invention, when the retaining lever is to be mounted on the connector housing, the flanged projections, formed respectively on those portions of the opposite sides of one of the retaining lever and the connector housing through which the pivot axis passes, are received respectively in the receiving grooves formed respectively in the opposite sides of the other of the retaining lever and the connector housing. As a result, the support shaft portions of the flanged projections are received in the receiving grooves, respectively. When the support shaft portion reaches a predetermined position in the associated receiving groove, the engagement portion provided along the receiving groove retains the flanged projection.

DETAILED DESCRIPTION OF THE PREFERRED EMBODIMENTS

A preferred embodiment of the present invention will now be described with reference to the accompanying drawings.

Figure 1:
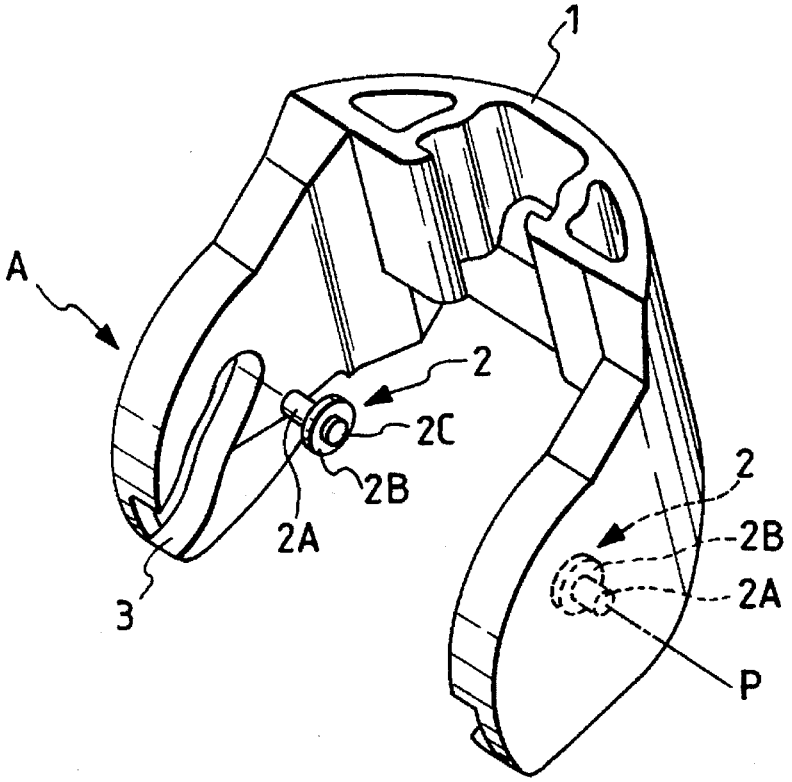
FIG. 1 is an exploded, perspective view of a portion of a first embodiment of a lever-type connector of the invention.
Figure 1:
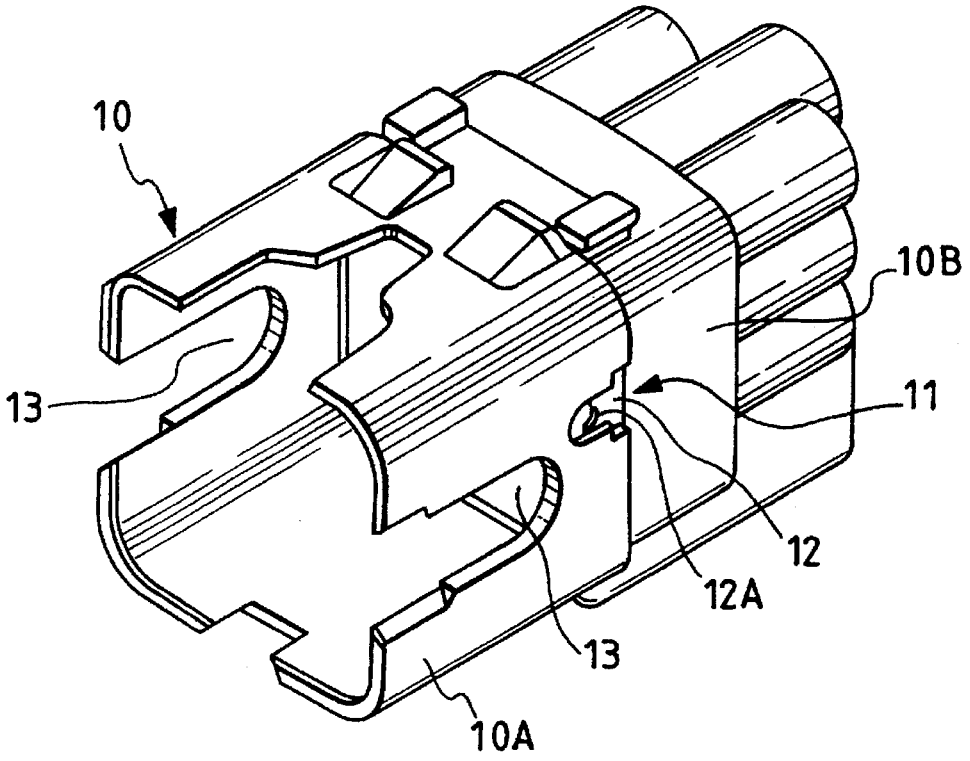

In FIG. 1, a lever-type connector A of the present invention comprises a retaining lever 1, and a female connector 10. The female connector 10 comprises an outer housing 10A provided at a front side, and an inner housing 10B provided at a rear side.

The retaining lever 1 includes opposite side walls, and a connecting portion interconnecting these side walls at their upper ends, the retaining lever 1 having a downwardly-open U-shape. The retaining lever 1 is pivotally movable about a predetermined pivot axis P passing through the opposite side walls thereof, and a pair of flanged projections 2 are formed respectively on those portions of inner surfaces of the opposite side walls through which the pivot axis P passes. Each of the flanged projections 2 has a pillar-like support shaft portion 2A, a flange 2B formed on a distal end of this support shaft portion, and a protuberance 2C projecting from the flange 2B. The retaining lever 1 has sliding grooves 3 formed respectively in the inner surfaces of the opposite side walls.

Receiving grooves 11 are formed respectively in opposite side walls of the outer connector housing 10A at a rear end thereof, and extend in the direction (longitudinal direction) of the axis of the connector, the receiving grooves 11 opening rearwardly. The support shaft portions 2A of the flanged projections 2 are received in the receiving grooves 11, respectively. When the support shaft portions 2A reach the innermost ends of the receiving grooves 11, respectively, the axes of the support shaft portions 2A are aligned with the pivot axis P.

Engagement portions 12 are formed on the inner housing 10B, are provided along the respective receiving grooves 11. Each of the engagement portions 12 has an elastic engagement section 12A at its distal end. When the flanged projection 2 is in the process of being received in the associated receiving groove 11, the elastic engagement section 12A is elastically deformed by the protuberance 2C to allow this protuberance 2C to pass past it. When this receiving operation is completed, each elastic engagement section 12A is returned to its initial position to retain the associated protuberance 2C.

Figure 2:
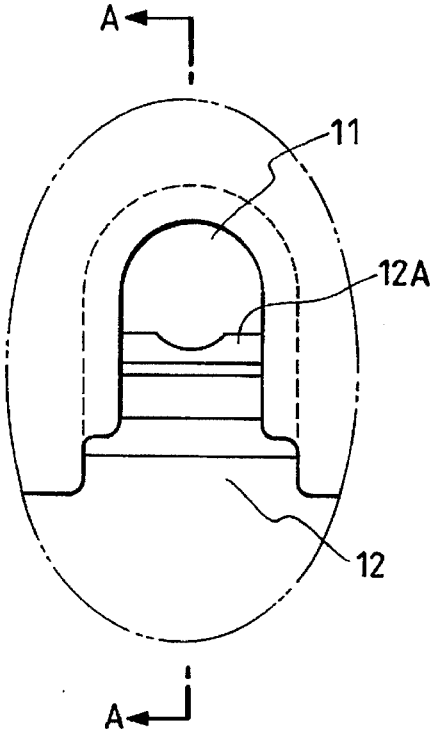
FIG. 2 is an enlarged view showing a receiving groove and an engagement portion of FIG. 1.

FIG. 2 is an enlarged view showing the receiving groove and the engagement portion in FIG. 1. As shown in the engagement portion 12 is provided along the associated receiving groove 11.

Figure 3:
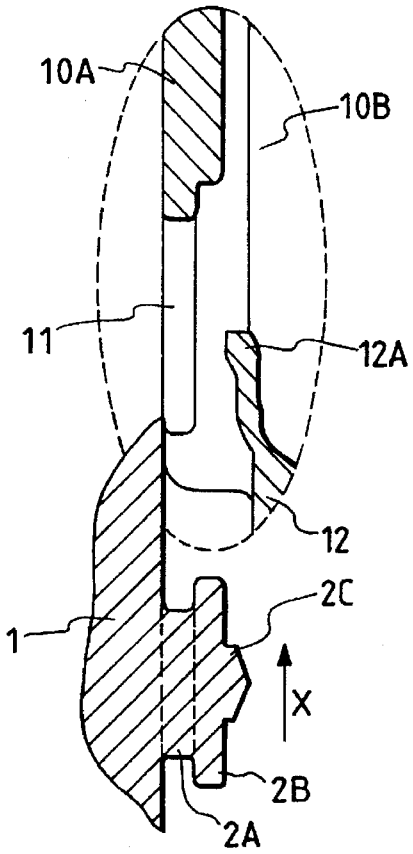
FIG. 3 is a cross-sectional view taken along the line A—A of FIG. 2 showing a condition before engagement.

FIG. 3 is a cross-sectional view taken along the line A—A of FIG. 2, showing a condition before the retaining lever 1 is engaged with the female connector 10. When the retaining lever 1 begins to be attached to the connector, the retaining lever 1 is moved toward the receiving grooves 1 along the outer housing 10A, and each flanged projection 2 is received in the associated receiving groove 11.

Figure 4:
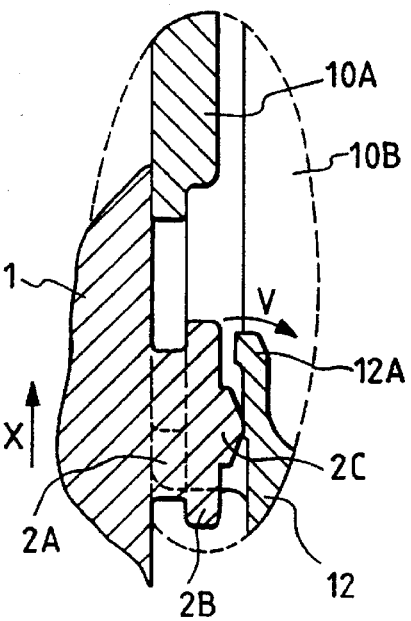
FIG. 4 is a cross-sectional view taken along the line A—A of FIG. 2 showing a condition in the process of engagement.

FIG. 4 is a cross-sectional view taken along the line A—A of FIG. 2, showing the process of engagement of the retaining lever 1 with the female connector 10.

The support shaft portion 2A of each flanged projection 2 formed on the retaining lever 1 is received in the associated receiving groove 11 of a U-shaped open to the rear end of the outer housing 10A. Then, when the retaining lever 1 is slidingly moved along the receiving grooves 11 in a direction of arrow X, the protuberance 2C, projecting from the flange 2B of each flanged projection 2, is brought into sliding engagement with the tongue-like elastic engagement section 12A formed at the distal end of the associated engagement portion 12 formed integrally with the inner housing 10B, and forces the elastic engagement section 12A inwardly (in a direction of arrow V).

Figure 5:
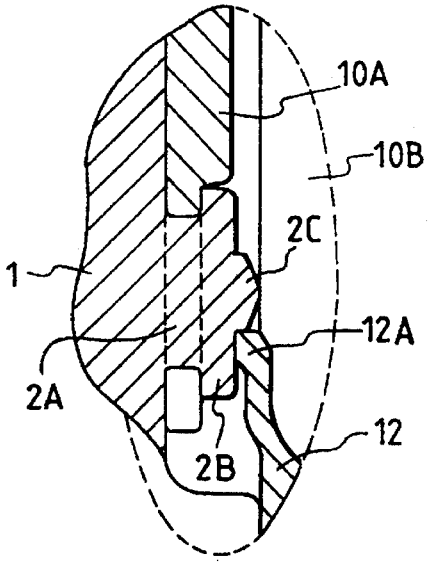
FIG. 5 is a cross-sectional view taken along the line A—A showing an engagement-completed condition.

FIG. 5 is a cross-sectional view taken along the line A—A of FIG. 2, showing a condition after the engagement of the retaining lever 1 with the female connector 10 is completed.

When the retaining lever 1 is pushed until each support shaft portion 2A reaches the innermost end of the associated receiving groove 11, the protuberance 2C projecting from the flange 2B completely passes past the elastic engagement section 12A. As a result, the inwardly-urged elastic engagement section 12A is returned into the initial position, so that the distal end of the elastic engagement section 12A becomes engaged with the rear side of the protuberance 2C of the flanged projection 2, located at its innermost position, to retain the same. As a result, the retaining lever 1 is retained there.

Thus, in the present invention, by merely pushing the retaining lever into the connector housing, the fitting and the retaining can be effected quite easily. Therefore, the efficiency of the connector-assembling operation can be greatly improved.

Even if an external force acts in a direction opposite to the direction of pushing of the retaining lever 1 after the retaining is achieved, the retaining lever will not be moved. Therefore, the retaining lever 1 is stably held in a retained condition.

The diameter of the flange 2B is larger than the width of the receiving groove 11, and therefore the support shaft portion 2A is prevented from disengaging from the receiving groove 11. This prevents the retaining lever 1 from being disengaged from the female connector 10 by an external impact or the like applied thereto after the retaining lever is mounted on the female connector.

In this manner, the retaining lever 1 is retained relative to the female connector 10.

Figure 6:
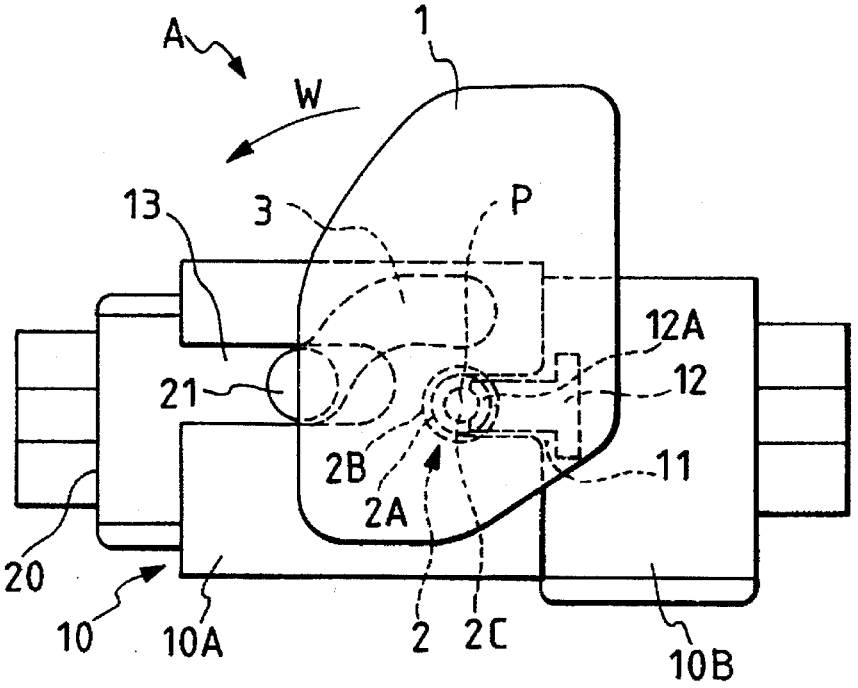
FIG. 6 is a front-elevational view of the lever-type connector of FIG. 1 showing a connector fitting process after the mounting of a lever.
Figure 7:
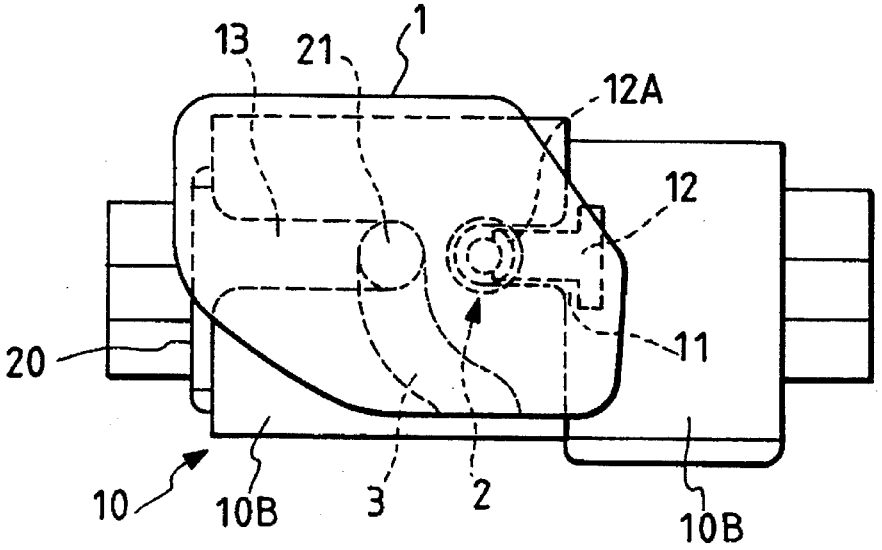
FIG. 7 is a front-elevational view of the lever-type connector of FIG. 6 in a completely-fitted condition.

FIG. 6 is a front-elevational view showing a process of fitting a male connector after the retaining lever is mounted on the lever-type connector A of FIG. 1. FIG. 7 is a front-elevational view showing a completely-fitted condition of the male connector.

In FIG. 6, the male connector 20 is inserted into the female connector 10 to a certain degree. Guide projections 21, formed respectively on opposite sides of the male connector 20, are fitted respectively into open ends of guide grooves 13 formed in the front end portion of the male connector 10, and are advanced, so that each of the guide projections 21 reaches a position where it is fitted in the associated sliding groove 3 in the retaining lever 1. Then, the retaining lever 1 is pivotally moved in a direction of arrow W, and as a result of this pivotal movement, one side wall of the sliding groove 3 is pressed against the guide projection 21, so that the guide projection 21 is drawn into the sliding groove 3 with a large force to further move along the guide groove 13. When the guide projection 21 is brought into an inner end wall of the sliding groove 3, the complete fitting is achieved, so that the two connectors are fitted together in a retained manner, as shown in FIG. 7.

Figure 8:
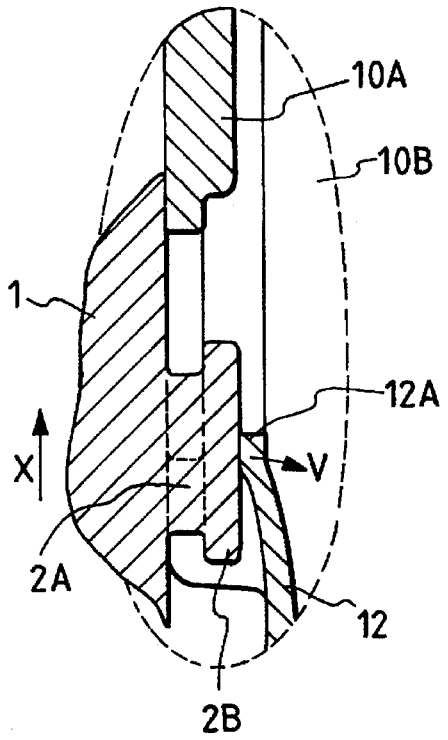
FIG. 8 is a view showing a condition in the process of engagement of a retaining lever in a modified form of the invention.
Figure 9:
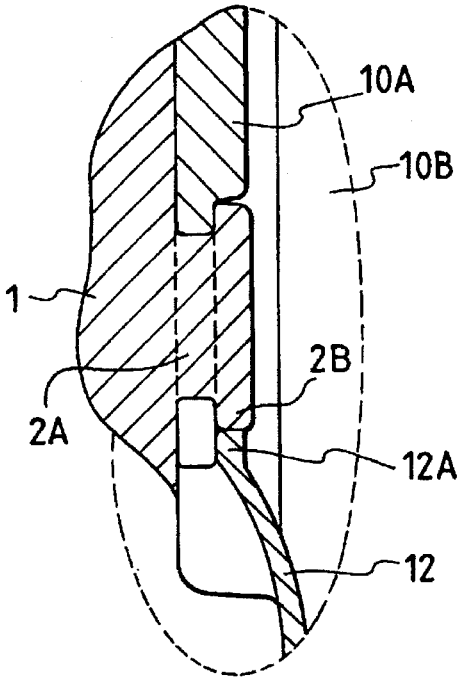
FIG. 9 is a view showing a condition in which the engagement of the retaining lever of FIG. 8 is completed.

FIGS. 8 and 9 shows a modified form of the present invention, and correspond to FIGS. 4 and 5, respectively, and FIG. 8 shows the process of engagement of a retaining lever 1 with a female connector 10 while FIG. 9 shows a completely-engaged condition.

In this modified construction, flanged projections 2 and 2 formed on the retaining lever 1 differ in configuration from those of the preceding embodiment. Therefore, those portions of this embodiment identical to those of the preceding embodiment will be designated by identical reference numerals, and explanation thereof will be omitted.

Each of the flanged projections 2 and 2 has a pillar-like support shaft portion 2A, and a flange 2B formed on a distal end of the support shaft portion 2A. Namely, the provision of the protuberance 2C in the preceding embodiment is omitted. Receiving grooves 11 in an outer connector housing 10A, as well as engagement portions 12 on an inner housing 10B, are similar to those in the preceding embodiment. The engagement portion 12 has an elastic engagement section 12A at its distal end.

With this construction, when the support shaft portion 2A of each flanged projection 2 formed on the retaining lever 1 is received in the associated receiving groove 11 in the outer housing 10A, the flange 2B of the flanged projection 2 is brought into sliding contact with the elastic engagement section 12A to urge the same inwardly as indicated by arrow V.

When the retaining lever 1 is pushed until the support shaft portion 2A reaches an innermost end of the receiving groove 11, the flange 2B completely passes past the elastic engagement section 12A. As a result, the elastic engagement section 12A is disengaged from the flange 2B to be returned into its initial position. Here, the elastic engagement section 12A is abutted at its distal end against a rear side of the flange 2B to hold the flanged projection 2 at the innermost end of the receiving groove 11, thereby retaining the retaining lever 1 in a manner to allow the pivotal movement of the retaining lever.

In this embodiment, also, by merely pushing the retaining lever into the connector housing, the fitting and the retaining can be effected quite easily, and the efficiency of the connector-assembling operation can be greatly improved. And besides, in the embodiment, the flanged projection 2 is simplified in configuration by omitting the protuberance (see FIGS. 3 to 5), and this improves the moldability thereof.

Figure 10:
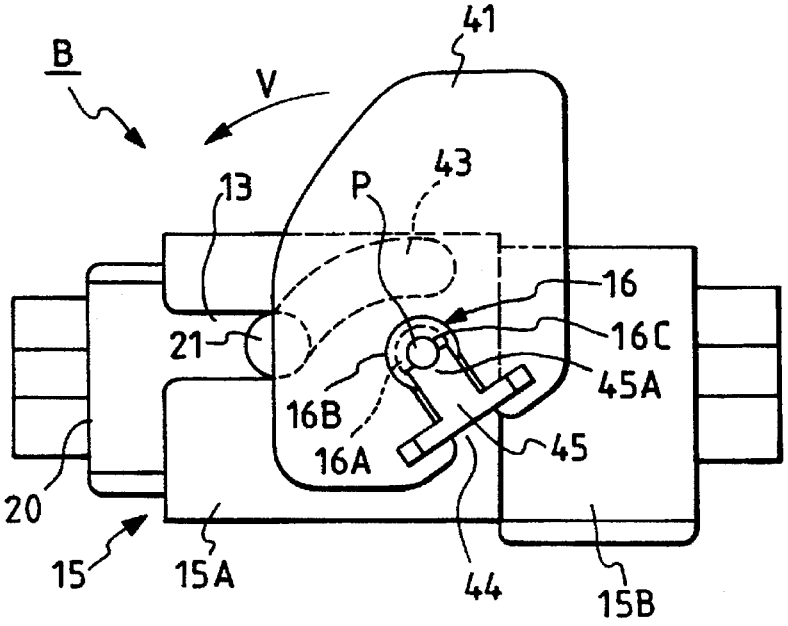
FIG. 10 is a front-elevational view of a second embodiment of a lever-type connector of the invention showing a connector-fitting process after the mounting of a lever.

FIG. 10 is a front-elevational view of a second embodiment of a lever-type connector of the invention, showing the process of fitting a connector after a retaining lever is mounted on the connector.

Figure 11:
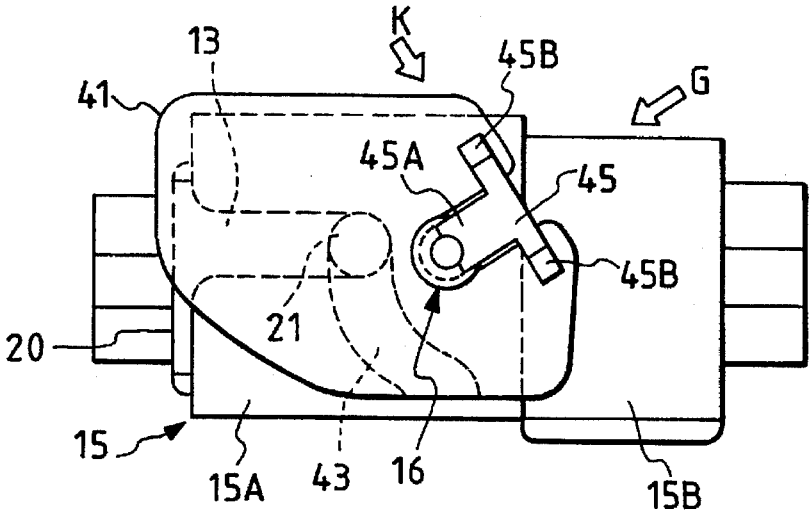
FIG. 11 is a front-elevational view of the lever-type connector of FIG. 10 in a completely-fitted condition.
Figure 12:
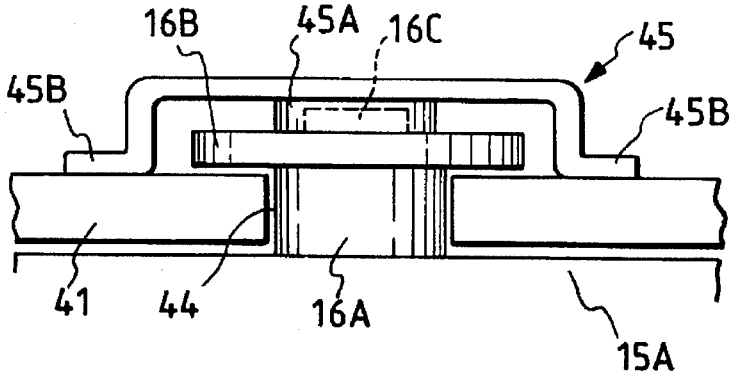
FIG. 12 is a view of an engagement portion as seen in a direction of arrow G of FIG. 11.
Figure 13:
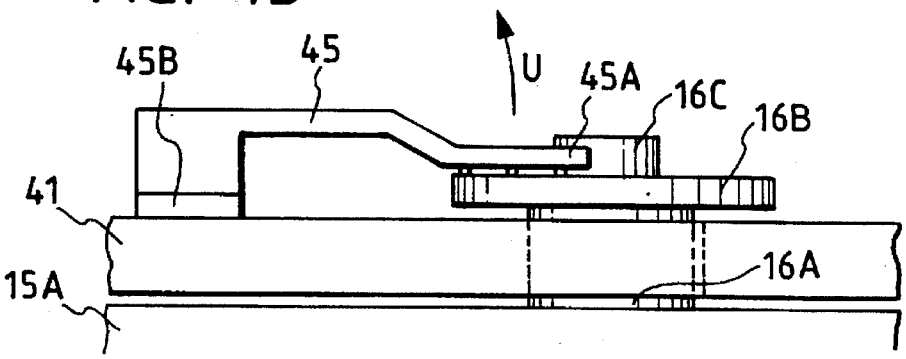
FIG. 13 is a view of the engagement portion as seen in a direction of arrow K of FIG. 11.
Figure 14:
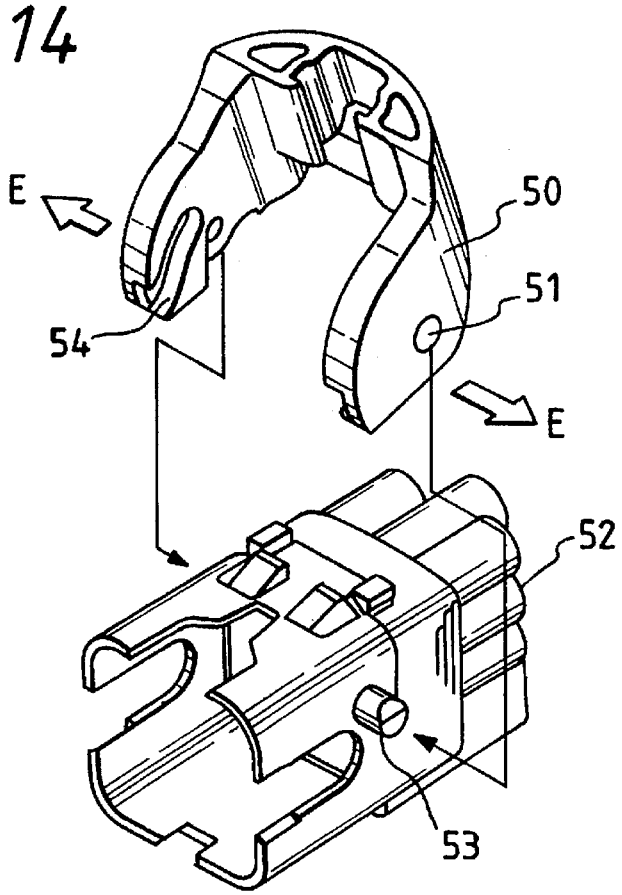
FIG. 14 is a perspective view of an important portion of a conventional lever-type connector with a lever mounted thereon.
Figure 15:
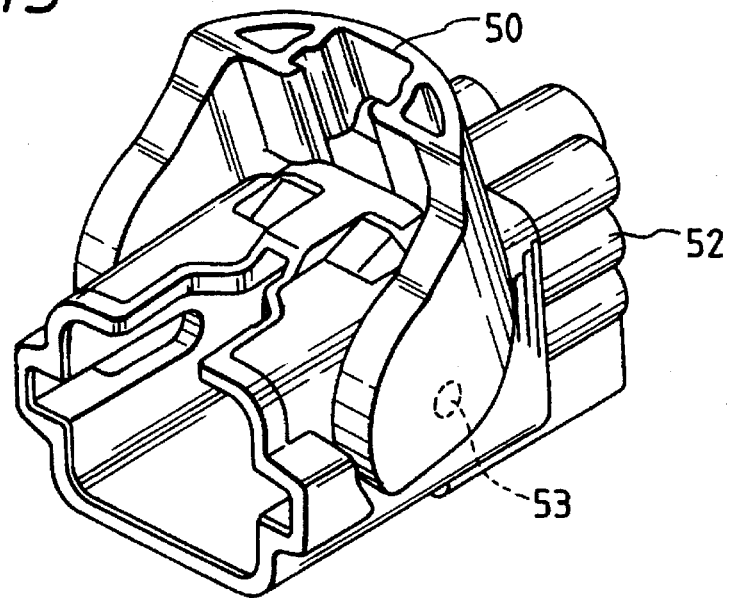
FIG. 15 is a perspective view of an important portion of the conventional lever-type connector after the lever is mounted thereon.

FIG. 11 is a front-elevational view showing a completely-fitted condition, FIG. 12 is a view showing an engagement portion as seen in a direction G of FIG. 11, and FIG. 13 is a view as seen in a direction K of FIG. 11.

In FIG. 10, in the lever-type connector B of the present invention, the retaining lever 41 is mounted on an outer housing 15A of a female connector 15 for pivotal movement about a pivot axis P passing through opposite side walls thereof, and sliding grooves 43 and 43 are formed respectively in the opposite side walls of the retaining lever 41. Guide projections 21 and 21, formed respectively on opposite sides of the other connector 20, are fitted respectively in the sliding grooves 43 and 43, and then the retaining lever 41 is pivotally moved to fit the two connectors together in a retained manner.

Flanged projections 16 are formed respectively on those portions of the opposite sides of the outer housing 15A of the female connector 15 through which the pivot axis P passes. In the first embodiment, the flanged projections are formed on the retaining lever whereas the flanged projections are formed on the housing in this second embodiment. Each of the flanged projections 16 and 16 has a pillar-like support shaft portion 16A, a flange 16B formed at a distal end of the support portion 16A, and a protuberance 16C projecting from the flange 16B.

Receiving grooves 44 and 44 for respectively receiving the support shaft portions 16A of the flanged projections 16 formed on the housing are formed respectively in the opposite side walls of the retaining lever 41. Engagement portions 45, which respectively retain the protuberances 16C and 16C when the support shaft portions 16A are received respectively in the receiving grooves 44, are provided respectively on the opposite side walls of the retaining lever 41 along the respective receiving grooves 44.

The process of mounting the retaining lever is carried out in a generally similar manner as described above for FIGS. 2 to 7 except that the arrangement of the flanged projections, the receiving grooves and the engagement portions is changed.

The condition of engagement of each flanged projection with the associated receiving groove and engagement portion is shown in FIGS. 12 and 13. Each engagement portion 45 is mounted at its mounting portions 45B on the retaining lever 41, and an elastic engagement section 45A of the engagement portion 45 extends along the associated receiving groove 44 in spaced relation to the outer surface of the retaining lever 41. The flange 16B and the protuberance 16C of the flanged projection 16 projecting from the female connector 15 passes through the space formed between the engagement portion 45 and the retaining lever 41.

During the time when the flange 16B and the protuberance 16C pass, the protuberance 16 is brought into engagement with the elastic engagement section 45A to force the same upwardly (in a direction of arrow U), and further advances. Immediately after the protuberance 16C passes past the elastic engagement section 45A, the elastic engagement section 45A is returned back to be retainingly engaged at its distal end with a rear side of the protuberance 16C. Therefore, the flanged projection 16 is held in a fixed condition. As is clear from FIGS. 12 and 13, the flanges 16B prevent the retaining lever 41 from being expanded, and therefore the retaining lever 41 will not be disengaged by an external force or the like after the retaining is effected.

As described above, in the present invention, the efficiency of the retaining lever-mounting operation is greatly improved, and also the retaining lever, once mounted on the housing, will not be disengaged from the housing, and with this construction the cause of malfunction is reduced, thereby enhancing the reliability of the product.

In the above embodiments, although the retaining lever is mounted on the female connector while the guide projections are provided on the male connector, this arrangement can be reversed.

As described above, in the lever-type connector of the present invention, the flanged projections are formed respectively on the opposite sides of one of the retaining lever and the connector housing on which the retaining lever is to be mounted, while the receiving grooves for respectively receiving the support shaft portions of the flanged projections are formed respectively in the opposite sides of the other. When each support shaft portion is received in the associated receiving groove, the engagement portion, provided at the receiving groove, retains the protuberance of the flanged projection. With this construction, by merely pushing the retaining lever into the connector housing, the fitting and the retaining can be effected quite easily. Therefore, the present invention greatly improves the efficiency of the connector-assembling operation.

In the invention, because the flanges have a diameter larger than the width of the receiving groove, the support shaft portions are prevented from disengaging from the respective receiving grooves. With this construction, the retaining lever, once mounted on the connector housing, is prevented from being disengaged from the connector housing by an external impact or the like, thereby providing the highly-reliable connector.

What is claimed is:

1. A lever-type connector comprising:

a connector;

a retaining lever pivotally mounted on the connector;

projections formed on opposite sides of a first one of the retaining lever and the connector, wherein each of the projections includes a support shaft, a flange formed on a distal end of the support shaft, and a protuberance extending longitudinally from the flange;

receiving grooves for receiving the projections, wherein each support shaft is received in an associated receiving groove; and engagement portions spanning a width of the receiving groove for engaging the projections, the receiving grooves and the engagement portions formed at opposite sides of a second one of the retaining lever and the connector.

2. A lever-type connector as claimed in claim 1, wherein the retaining lever is pivotally mounted about a pivot axis, and the engagement portion includes an elastic engagement section at a portion of the engagement portion adjacent to the pivot axis.

3. A lever-type connector as claimed in claim 1, wherein the retaining lever includes sliding grooves formed on opposite sides of the retaining lever for receiving guide projecting portions projecting from a second connector.

4. A lever-type connector comprising:

a connector;

a retaining lever pivotally mounted on the connector;

projections formed respectively on opposite sides of a first one of the retaining lever and the connector, each of the projections including a support shaft, a flange formed on a distal end of the support shaft, and a protuberance extending longitudinally from a side of the flange opposite the pillar-like support shaft;

receiving grooves for receiving the projections formed at opposite sides of a second one of the retaining lever and the connector; and engagement portions for engaging the projections, the engagement portions formed at opposite sides of a second one of the retaining lever and the connector.

5. A lever-type connector as claimed in claim 4, wherein the retaining lever includes sliding grooves formed on opposite sides of the retaining lever for receiving guide projecting portions projecting from a second connector.

6. A lever-type connector as claimed in claim 4, wherein the retaining lever is pivotally mounted about a pivot axis, and the engagement portion includes an elastic engagement section at a portion of the engagement portion adjacent to the pivot axis.

7. A lever-type connector comprising:

a connector;

a retaining lever pivotally mounted on the connector;

projections formed respectively on opposite sides of a first one of the retaining lever and the connector, each of the projections including a support shaft, a flange formed on a distal end of the support shaft and a protuberance extending longitudinally from a side of the flange opposite the pillar-like support shaft;

receiving grooves for receiving the projections formed at opposite sides of a second one of the retaining lever and the connector; and engagement portions formed at opposite sides of the second one of the retaining lever and the connector for engaging the projections, wherein the second one of the retaining lever and the connector is retained between the flanges and the first one of the retaining lever and the connector.

8. A lever-type connector as claimed in claim 7, wherein the retaining lever includes sliding grooves formed on opposite sides of the retaining lever for receiving guide projecting portions projecting from a second connector.

9. A lever-type connector as claimed in claim 7, wherein the retaining lever is pivotally mounted about a pivot axis, and the engagement portion includes an elastic engagement section adjacent to the pivot axis.

10. A lever-type connector comprising:

first and second connectors to be fitted together, the first connector having a housing;

a retaining lever mounted on the first connector about a pivot axis passing through opposite sides of the first connector to retain the first and second connectors together;

projections formed respectively on opposite sides of a first one of the retaining lever and the housing of the first connector, each of the projections including a pillar-like support shaft, a flange formed on a distal end of the support shaft and a protuberance extending longitudinally from a side of the flange opposite the pillar-like support shaft;

receiving grooves for respectively retaining the projections, the receiving grooves formed in opposite sides of a second one of the retaining lever and the housing of the first connector; and engagement portions for retaining the projections, the engagement portions being formed respectively at opposite sides of the second one of the retaining lever and the housing of the first connector, wherein portions of the second one of the retaining lever and the housing of the first connector are engaged between the flanges and the first one of the retaining lever and the housing of the first connector.

11. A lever-type connector as claimed in claim 1, wherein the retaining lever includes sliding grooves formed on the opposite sides of the retaining lever for receiving guide projecting portions projecting from the second connector.

12. A lever-type connector as claimed in claim 1, wherein each of the engagement portions includes an elastic engagement section adjacent to the pivot axis.

* * * * *

UNITED STATES PATENT AND TRADEMARK OFFICE

CERTIFICATE OF CORRECTION

PATENT NO. : 5,647,752

DATED : July 15, 1997

INVENTOR(S) : TAGUCHI

It is certified that error appears in the above-identified patent and that said Letters Patent is hereby corrected as shown below:

Column 8, Line 58, change "claim 1" to --claim 10--;

Line 62, change "claim 1" to --claim 10--.

Signed and Sealed this

Twelfth Day of January, 1999

*Attest:*

*Attesting Officer*

*Acting Commissioner of Patents and Trademarks*